United States Patent [19]

Jse

[11] Patent Number: 4,701,078

[45] Date of Patent: Oct. 20, 1987

[54] PILE CONSTRUCTION METHOD FOR IMPROVING BEARING POWER

[76] Inventor: Lin J. Jse, 4th Fl., No. 37-39, Sec. 2, Shih Chuan Road, Panchiao City, Taiwan

[21] Appl. No.: 864,079

[22] Filed: May 16, 1986

Related U.S. Application Data

[63] Continuation-in-part of Ser. No. 602,595, Apr. 20, 1984, abandoned.

[51] Int. Cl.[4] ..... E02D 5/44

[52] U.S. Cl. ..... 405/238; 405/233; 405/236; 405/263

[58] Field of Search ..... 405/237, 238, 240, 243, 405/232, 233, 263, 264

[56] References Cited

U.S. PATENT DOCUMENTS

| | | | |
|---|---|---|---|
| 1,084,063 | 1/1914 | Bignell | 405/237 |
| 1,279,834 | 9/1918 | Blumenthal | 405/237 |
| 1,873,244 | 8/1932 | Zucco | 405/238 |
| 2,373,276 | 4/1945 | Thornley | 405/238 |
| 2,555,359 | 6/1951 | Montague | 405/238 |
| 3,241,325 | 3/1966 | Simons | 405/237 |
| 3,438,212 | 4/1969 | Turzillo | 405/237 X |
| 3,559,412 | 2/1971 | Fuller | 405/239 X |
| 3,568,452 | 3/1971 | Stifler | 405/237 |
| 3,742,717 | 7/1973 | Wey | 405/238 |
| 3,864,923 | 2/1975 | Turzillo | 405/238 |
| 4,040,260 | 8/1977 | Pryke | 405/239 |
| 4,116,012 | 9/1978 | Abe et al. | 405/239 X |

FOREIGN PATENT DOCUMENTS

| | | | |
|---|---|---|---|
| 306033 | 6/1918 | Fed. Rep. of Germany | 405/240 |

*Primary Examiner*—Dennis L. Taylor

*Attorney, Agent, or Firm*—Jeffers Hoffman & Niewyk

[57] ABSTRACT

The invention provides a pile construction method which allows repeated formation of a supplemental base concrete body at the bottom of a cast-in-place pile, wherein before a previously introduced cement mortar consolidates at the bottom of the pile, a soil stabilizing liquid agent is injected through an injection tube which extends to the bottom of a pile so as to penetrate into the earth surrounding the bottom of the pile. After the cement mortar consolidates, the flow passages of the soil stabilizing agent become permanent passages in the pile base for a next injection of cement mortar.

5 Claims, 8 Drawing Figures

PILE CONSTRUCTION METHOD FOR IMPROVING BEARING POWER

This application is a continuation-in-part application of U.S. patent application Ser. No. 602,595, filed Apr. 20, 1984, which is now abandoned.

BACKGROUND OF THE INVENTION

This invention relates to a method of constructing a pile and particularly to a pile construction method by which the base of a pile can be enlarged again and again to increase the bearing power of the pile.

In pile constructions, in order to increase the bearing power of a pile, the pile is usually formed with an enlarged base at the bottom end of the pile to increase the end bearing power or the friction of the lower portion of the pile with the surrounding earth, or formed with a roughened, irregular outside surface to increase the skin friction of the pile with the surrounding earth. Various methods have existed in the art to form an enlarged base at the bottom of a pile, or a roughened, irregular outside surface on a pile. Examples of these methods are disclosed in U.S. Pat. Nos. 1,279,834, 2,373,276, 2,555,359, 3,241,325, 3,742,717 and 3,864,923.

U.S. Pat. No. 3,241,325 discloses a process in which cement mortar is injected to penetrate into the surrounding earth through pipes extending between a pile casing and the surrounding earth to form a roughened jacket of cement mortar around the pile, and to penetrate into the earth below the bottom of the pile through central conduits which extend through the hollow of the pile casing and are connected to a bottom cover of the pile casing having a distributing chamber. The cement mortar, which is injected into the distributing chamber after the pile is formed, penetrate into the earth below the bottom of the pile, and form an increased base friction surface of the pile with the earth.

U.S. Pat. No. 2,555,359 discloses a process which can enlarge again and again the base of a pile after the pile is formed until the pile achieves a desired bearing capacity. After an enlarged base is formed at the bottom of a pile, an additional enlarged base body can be formed by drilling a passage in the previously formed enlarged base for inserting and extending a central injection tube to a location below said base, forming an enlarged cavity below said enlarged base and filling the cavity with cement mortar by means of the central injection tube.

Although in both of the above-described methods, the base of a pile can be enlarged after the pile is formed, the latter method is more advantageous than the former since it can be used to enlarge a pile base again and again. However, the latter method is still found unsatisfactory because of the necessity it engenders for drilling a passage in the previously formed base.

SUMMARY OF THE INVENTION

An object of the invention is to provide a pile construction method by which a base of a pile can be enlarged again and again without the necessity for drilling passages in the previously formed concrete body.

The invention provides an improvement to a method of constructing a cast-in-place concrete pile including driving a pile casing into the earth, making a hollow below the end of the pile casing, and filling the pile casing and the hollow with cement mortar to form a concrete pile. The improvements comprise: before filling the pile casing and the hollow, lowering an injection tube into the pile casing until the tube extends into the hollow; injecting a soil stabilizing agent through the injection tube before the cement mortar which fills the pile and the hollow consolidates; then injecting a highly flowable cement mortar through the injection tube into the surrounding soil so as to form a supplemental concrete body; and injecting a soil stabilizing liquid agent through the injection tube before the highly flowable cement mortar consolidates.

With the improvements as described above, supplemental base bodies can be formed again and again substantially around the original base body so as to increase the magnitude of the base of the pile. Since the method can create fluid passages in the concrete body formed by injecting a soil stabilizing liquid agent through the cement mortar to maintain flow passages before the cement mortar consolidates, no drilling process is necessary to provide passages in the base of the pile. Such a method can be employed for forming a supplemental base again and again for a previously formed pile to increase the bearing power of the pile when it is found that the pile is inadequate for supporting a structure above it. Even if the structure is already installed on the pile, a supplemental pile base can be formed in the earth by simply injecting a highly flowable cement mortar into the earth through the injection tube which is permanently attached to the pile. A soil stabilizing agent is always injected subsequent to the injection of the cement mortar so that fluid passages will be left in the supplemental concrete body for a next injection of the cement mortar.

The present exemplary preferred embodiment will be described in detail with reference to the following drawings.

DETAILED DESCRIPTION OF THE PREFERRED EMBODIMENT

Figure 1:
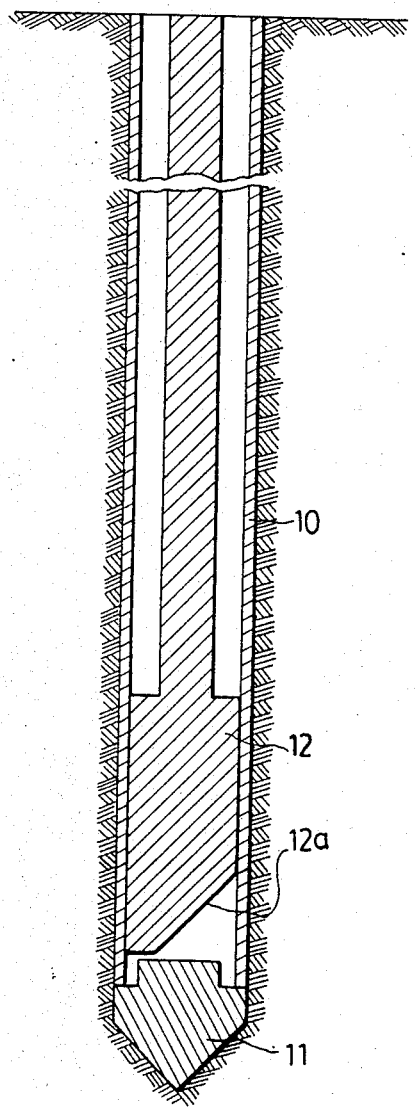
FIG. 1 is a schematic view of a pile casing which is driven into the earth with a bottom shoe and a mandrel.
Figure 2:
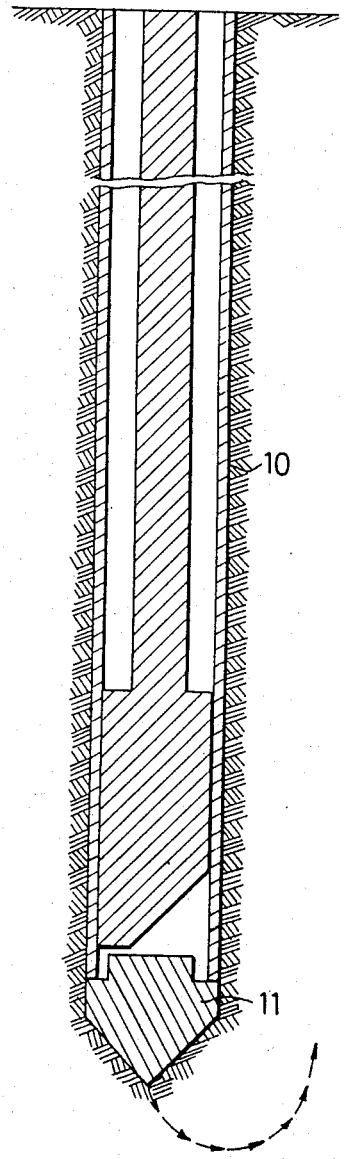
FIG. 2 is a schematic view showing a direction that the shoe will turn to a side from the shell.
Figure 3:
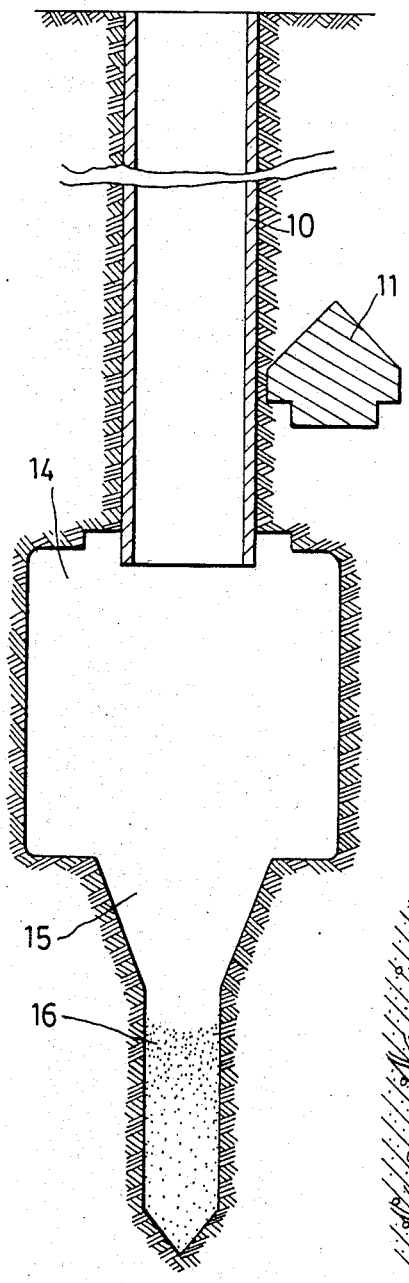
FIG. 3 is a schematic view showing that an enlarged hollow is formed below the shell.
Figure 4:
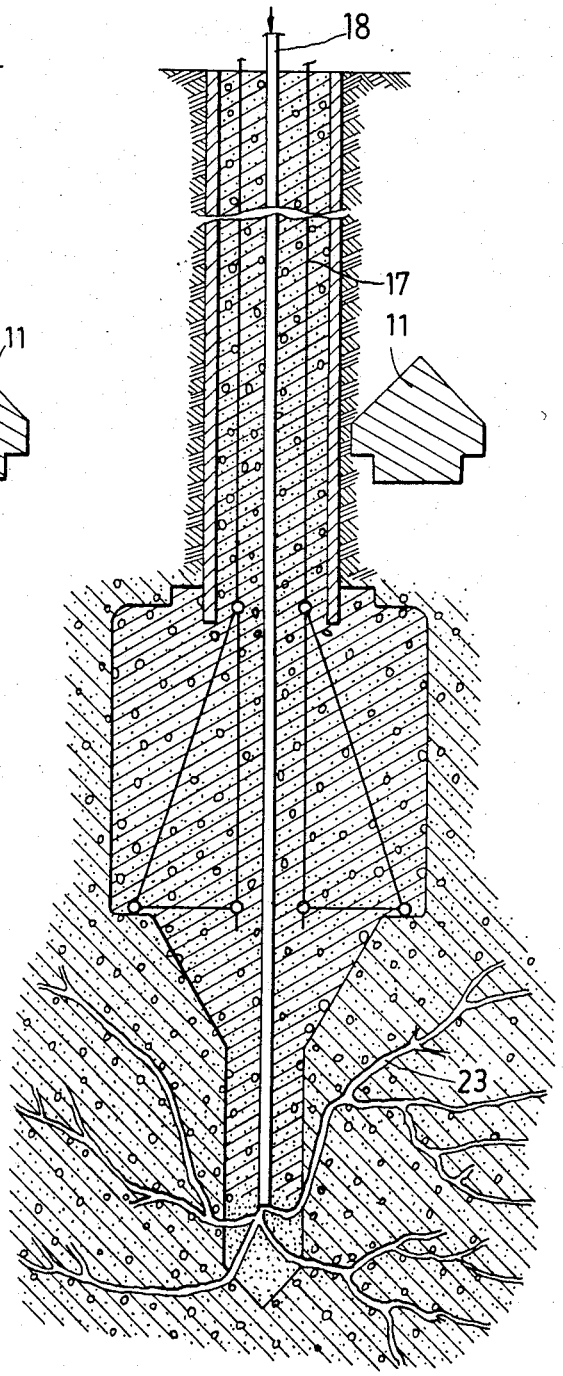
FIG. 4 is a schematic view showing the bottom part of the pile formed according to the invention.

Referring to the drawings, in the construction of a pile according to the invention, a pile casing 10 with a releaseable shoe 11 is driven into the ground in a manner as known in the art. The shoe 11 is hammered by means of a mandrel 12 having a bevelled face **12*a* so that the shoe 11 separates from the the casing 10. If the shoe 11 is driven into a rock having a bearing capacity lower than 20 kg/sq.cm, it will move straight forward to a depth spaced from the end of the casing 10. If the soil bearing capacity is greater than 20 kg/sq.cm, the shoe 11 will turn to a side as shown in FIG. 2**.

After the shoe 11 is removed from the bottom of the casing 10, an enlarged hollow 14 is made at the bottom of the casing 10 by excavating soil. Preferably, a tapering portion 15 and a deeper narrow portion 16 are provided below the enlarged hollow 14. During excavation, water is jetted into the hollow to be mixed with the loosened soil, and mud and muddy water is pumped out of the hollow and the casing 10. The specified configuration of the hollow 14 and the portions 15 and 16 provides an advantage in that the mud remaining in the enlarged hollow 14 can descend to the portion 16 through the portion 15 so that the enlarged hollow 14 can be maintained as a complete hollow free of mud or loosened soil.

After the enlarged hollow is made, a reinforcing frame 17 and an injection tube 18 are lowered into the enlarged hollow 14 and the shell casing 10. The injection tube 18 extends to the deeper narrow portion 16. Cement mortar is injected to fill the casing 10, the enlarged hollow 14, and the hollow portions 15 and 16. Before the cement mortar consolidates, a fluid such as a soil stabilizing agent is injected through the injection tube 18 so as to stabilize the surrounding earth and to prevent blockage at the bottom end of the tube 18. The injection of the soil stabilizing agent continues until the cement mortar filling the pile casing 10 and hollow portions 14, 15 and 16 consolidates. The flow passages created by the high pressure flowing soil stabilizing agent before the cement mortar consolidates becomes permanent flow passages 23 after the cement mortar consolidates. These permanent passages 23 extend from the end of the injection tube into the earth surrounding the concrete body formed into the hollow 16 and 15.

Afterwards, a charge of highly flowable cement mortar is injected through the injection tube 18. The cement mortar flows through the passages 23 and penetrates into the surrounding earth. When the surrounding earth reaches a saturated condition, the soil stabilizing agent is again injected in place of the cement mortar, so as to form flow passages in the cement mortar. The injection of the soil stabilizing agent continues until the cement mortar consolidates. After the cement mortar consolidates, a supplemental concrete body is formed with additional permanent flow passages 23 around the previously formed base, thereby enlarging the base of the pile. Such a supplemental concrete body can be formed again and again by the way as described above.

Figure 6:
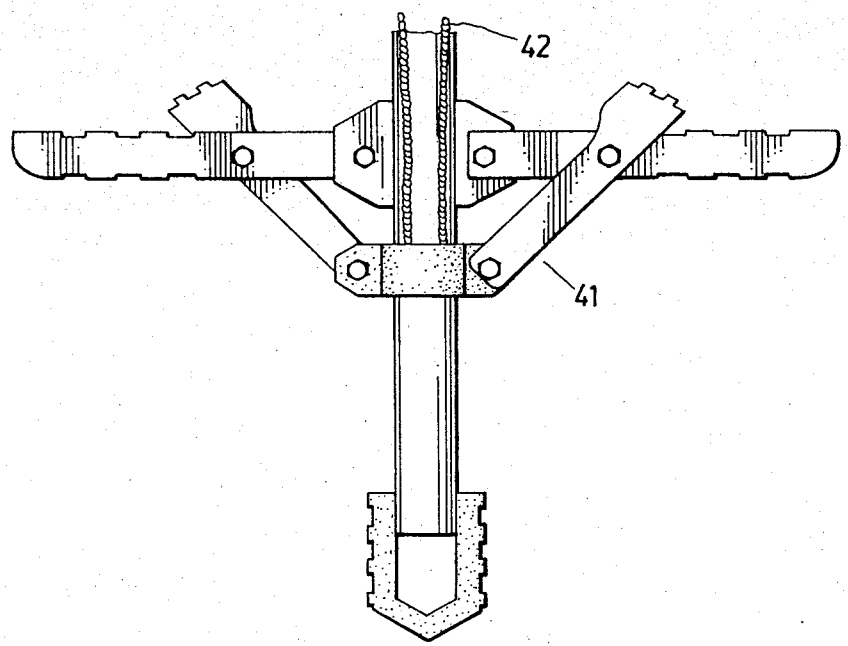
FIG. 6 is a side elevation view of the soil cutting device of FIG. 5.
Figure 5:
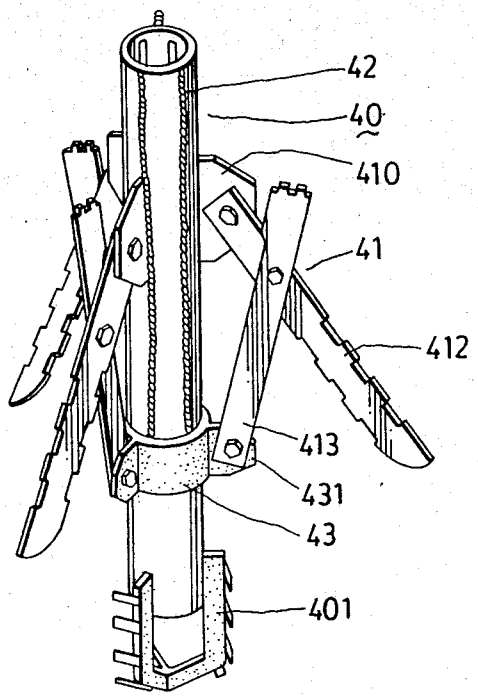
FIG. 5 is a perspective view of a soil cutting device.

FIGS. 5 and 6 illustrate a device for excavating an enlarged hollow at the bottom of a pile casing. Preferably, the device is employed in the invention to form the enlarged hollow 14 and the hollow portions 15 and 16. The device is comprised of a rotary hollow shaft 40, a collapsible cutting blade assembly 41 and a controlling rope means 42. At the bottom end of the hollow shaft 40 is attached a cutter 401. On the periphery of the hollow shaft 40 are three radial brackets 410 on which are mounted pivotally three cutter blades 412 respectively. A slider sleeve 43 is attached slideably to the hollow shaft 40 below the brackets 410 and connected to the controlling rope means 42. Three cutter blades 413 are connected pivotally to the blades 412 and the slider sleeve 43. The slider sleeve 43 can be moved upward or downward by operating the rope means 42 to put the cutter blades 413 and 412 in a collapsed position or in an extended position (FIG. 6).

Figure 8:
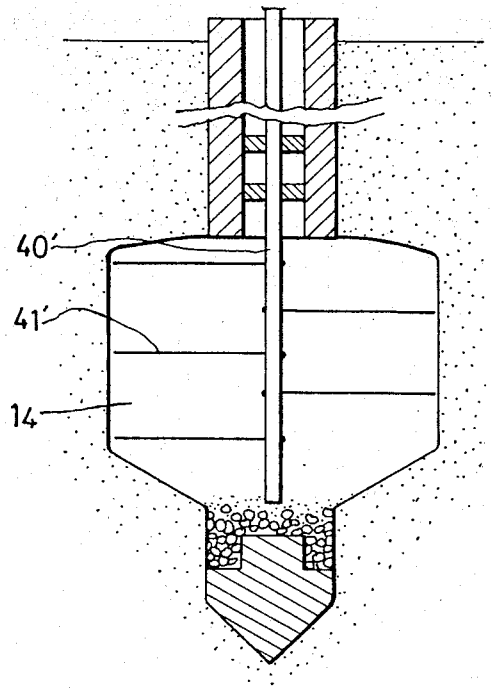
FIGS. 7 and 8 are schematic views showing a soil beating device working in the earth.
Figure 7:
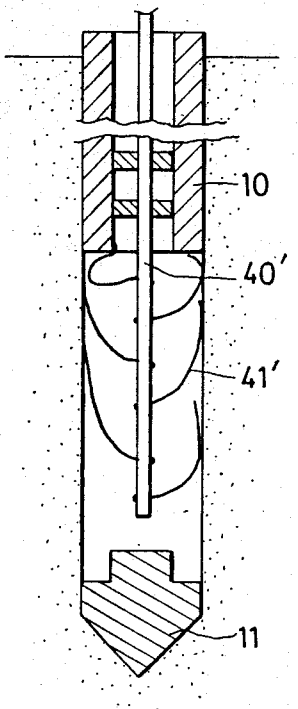

The above-described device is not suitable for drilling an enlarged hollow base when the soil includes of a large percentage of gravel. In this situation, it is suggested to use a more flexible arrangement such as that shown in FIGS. 7 and 8, wherein a rotary shaft 40' to which are attached strong ropes or steel chains 41' is used for beating the soil. The length of the steel chains or the strong ropes may be chosen according to how much extent of the hollow is desired. When the shaft is rotated, the steel chains 41' spin and beat the surrounding soil and gravels. The soil is churned into slurry by jetting water and then pumped onto the ground surface. The gravels are beaten down and collected at the bottom side of the hollow excavated.

With the invention thus explained, it is apparent that various modifications and variations can be made without departing from the scope of the invention. It is therefore intended that the invention be limited as indicated in the appended claims.

What I claim is:

1. A method of constructing a cast-in-place concrete pile including driving a pile casing into the earth, making a hollow below the end of the pile casing, filling the pile casing and the hollow with cement mortar to form a concrete pile with an enlarged base, wherein the improvements comprise: before filling the pile casing and the hollow with cement mortar, lowering an injection tube into the pile casing until the tube extends into the hollow; after filling the pile casing and the hollow with cement mortar and before the cement mortar consolidates, injecting a soil stabilizing agent through the injection tube and then through the cement mortar into the surrounding soil so as to form first passages in the enlarged base; after the cement mortar consolidates, injecting a highly flowable cement mortar through the injection tube and then through the first passages into the surrounding soil so as to form a supplemental concrete body; and subsequent to the injection of the highly flowable cement mortar and before the highly flowable cement mortar consolidates, injecting a soil stabilizing liquid agent through the injection tube, then through the first passages, and finally through the highly flowable cement mortar into the surrounding soil so that second passages are formed in the supplemental concrete body.

2. A method of constructing a concrete pile with an enlarged base, comprising the steps of:

driving a pile casing into the earth;

making an enlarged hollow below the end of the pile casing;

lowering an injection tube into the pile casing until the tube extends into the bottom part of the enlarged hollow;

filling the pile casing and the hollow with cement mortar to form a concrete pile with an enlarged base; and injecting a liquid through the injection tube before the cement mortar consolidates so as to prevent blockage at the end of the tube and to form first passages extending from the end of the tube to the surrounding of the enlarged base.

3. The method of constructing a concrete pile of claim 2 and further comprising the step of: injecting a highly flowable cement mortar through the injection tube into the surrounding soil so as to form a supplemental base.

4. The method of constructing a concrete pile of claim 3 and further comprising the step of: injecting a liquid through the injection tube before the highly flowable cement mortar consolidates so that second passages extending from the first passages are formed in the supplemental base.

5. The method of constructing a concrete pile of claim 4 in which: the liquid injected through the injection tube is a soil stabilizing agent.

* * * * *